US005299443A

United States Patent [19]

Nakamura

[11] Patent Number: 5,299,443

[45] Date of Patent: Apr. 5, 1994

[54] SLIDE ADJUSTING DEVICE FOR USE IN FORGING PRESS

[75] Inventor: Masatoshi Nakamura, Osaka, Japan

[73] Assignee: Kurimoto, Ltd., Osaka, Japan

[21] Appl. No.: 922,223

[22] Filed: Jul. 31, 1992

[30] Foreign Application Priority Data

Apr. 28, 1992 [JP] Japan ..... 4-135856

[51] Int. Cl.[5] ..... B21J 9/18

[52] U.S. Cl. ..... 72/446; 72/450; 72/452; 100/257

[58] Field of Search ..... 72/402, 406, 450, 452; 100/257

[56] References Cited

U.S. PATENT DOCUMENTS

| | | | |
|---|---|---|---|
| 3,908,436 | 9/1975 | Bothe | 100/257 |
| 3,929,000 | 12/1975 | Kralowetz | 72/452 |
| 4,464,924 | 8/1984 | Kralowetz | 72/452 |
| 5,000,021 | 3/1991 | Nakamura et al. | 72/446 |

*Primary Examiner*—David Jones

*Attorney, Agent, or Firm*—Jones, Tullar & Cooper

[57] ABSTRACT

The present invention provides a small-sized slide adjusting device for use in a forging press manufactured by a simplified manufacturing process. An adjusting lever is provided with a nut receiving section, and a nut to be received in the nut receiving section is provided with turning shafts in axial alignment. A mounting hole is provided through two sides of the receiving section, a disc having an eccentric through hole is fitted in each mounting hole, and the turning shafts of the nut are fitted in a respective through hole. In one embodiment the nut is provided with a female screw situated at a right angle to the axial alignment direction of the turning shafts, and one end of the screw is connected to a motor mounted on a slide. In the slide adjusting device of this construction, a variation in height occurs due to the circular arc motion at the time of inclined movement of the adjusting lever making a center of a wrist pin a fulcrum followed by turning movement of the disc and turning shafts. Every slide adjusting movement which occurs is performed in a turning slide manner, whereby concentration of stress is alleviated resulting in a small-sized device.

4 Claims, 6 Drawing Sheets

FIG. 4(A)
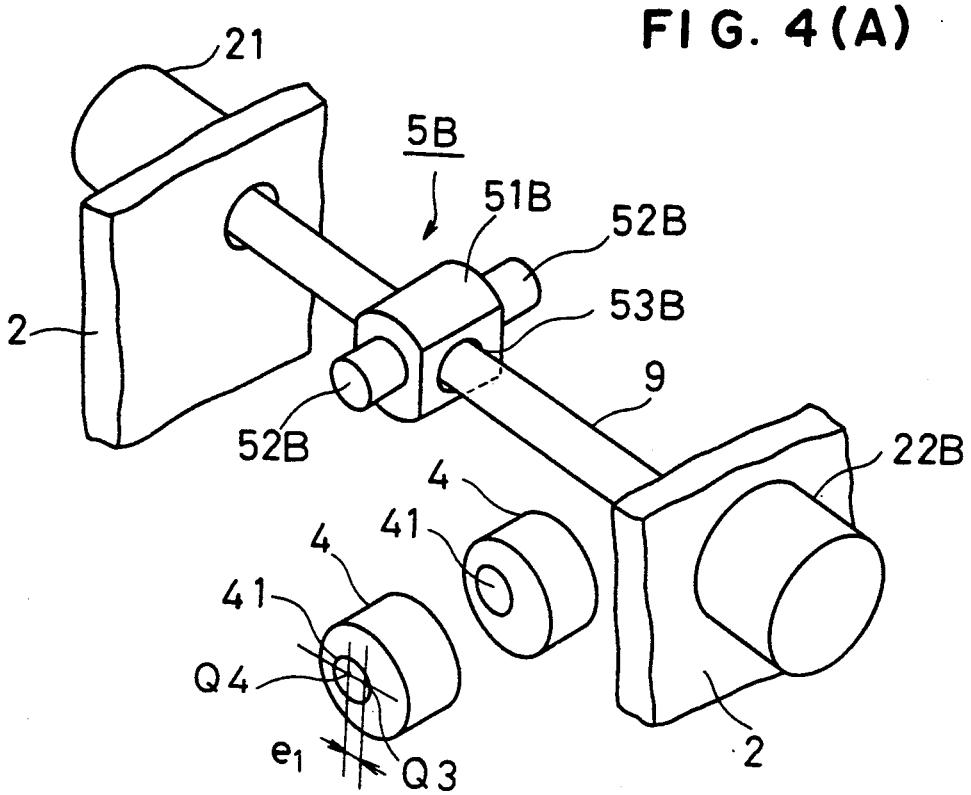
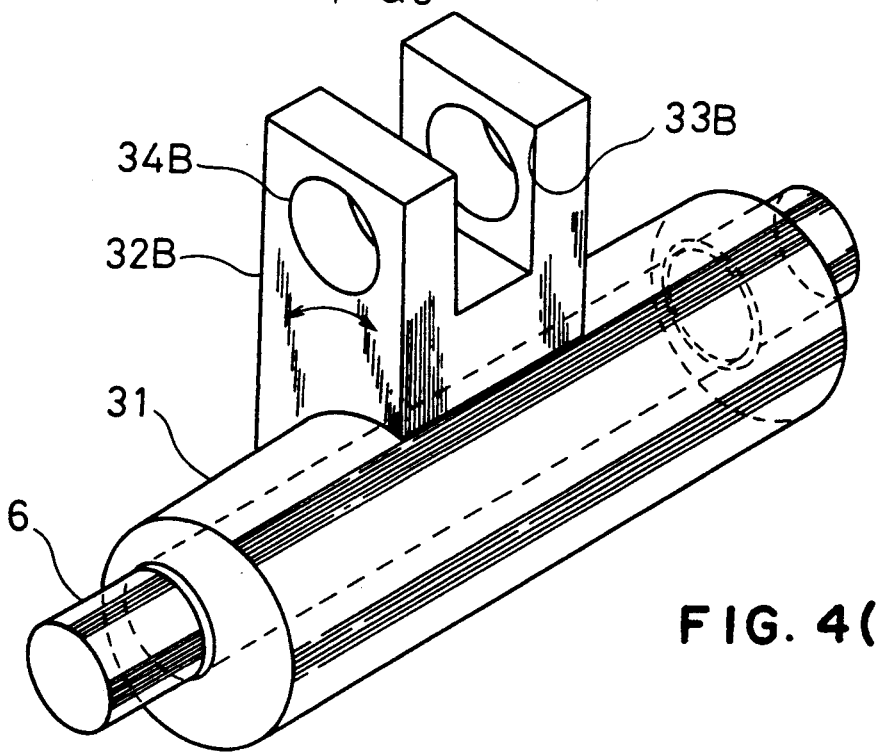
FIG. 4(B)

SLIDE ADJUSTING DEVICE FOR USE IN FORGING PRESS

BACKGROUND OF THE INVENTION

1. Field of the Invention

The present invention relates to a slide adjusting device for use in forging press.

2. Prior Arts

As is well known, generally in a forging press, the upper section of a connecting rod is placed on an eccentric part of a crankshaft from the outside, and the lower section is divided into two fork-like parts in which a wrist pin is received by the top ends of the two fork-like parts. Since the wrist pin is inserted in the slide to support the slide at two ends in a suspended manner, the eccentric motion of the crankshaft is transformed to a vertical motion of the slide through the connecting rod and wrist pin, whereby a work piece held between an upper mold attached to the lower part of the slide and a lower mold mounted on a bed, is pressed to be forged by the mold.

The shape and size of the products formed by one forging press are not always constant, and the weight and volume of the work pieces to be forged vary at all times. Accordingly, the optimum load for pressing a work piece is not constant but should be adjusted whenever required. In an automatic continuous forging system equipped with a transfer machine for transferring consecutively work pieces using a plurality of molds, appropriate adjustment of the total load applied vertically from above is required, depending upon whether every mold is charged with a work piece or only a part of the molds is charged therewith. If this adjustment is not appropriate, there may arise such disadvantages as breakdown of the molds, insufficient forging, etc. As for the method of such adjustment, it has been popularly performed by adjusting the die height position by moving the vertically position of the slide, and actually several attempts for adjusting the slide of forging presses have been heretofore proposed.

In Japanese Utility Model Registration Publication (examined) No. 32478/1984, a device for adjusting the slide position is disclosed as shown in FIG. 5, and in which an adjusting lever 3*a* having an eccentric center Q1 dislocated from the center Q2 of a wrist pin 6*a* is disposed for turning the wrist pin. An adjusting screw 7*a* and a nut 5*a* mate with each other and are fixed to the adjusting lever 3*a*. The vertical position of the slide may be freely adjusted by turning the adjusting screw 7*a* either forwardly or reversely. It is described in this publication that since one end of the adjusting screw is movably supported at a cylinder mounted on the slide, adjustment of the slide position may be carried out by the vertical motion of the slide without reducing cylinder pressure.

In Japanese Laid-Open Patent Publication (unexamined) No. 75500/1990, another slide adjusting device is disclosed as shown in FIGS. 6, 7(A) and 7(B). A bearing section 32*b* is provided which is located in the middle part of an eccentric shaft 31*b*. The adjusting lever 3*b* is of an adjusting lever 3*b* disposed eccentrically from the center of two wrist pins 6*b* which are engaged with front end of a connecting rod 1*b* from the outside. Two sliders 101 are connected with each other through a link pin 102 and are received engagedly in the bearing section 32*b* so that a rod 9*b* inserted through the middle part of the link pin 102 and fixed thereto is coupled respectively with large and small cylinders 106, 104 each fixed to a slide 2*b*. One end of the rod 9*b* is fixed to a piston 105 sliding in the small cylinder 104 and the other end is fixed to another piston 107 sliding in the large cylinder 106. Accordingly, when supplying actuation oil into the large and small cylinders under equal feed pressure, a difference is produced in the force applied to the rod due to the difference between the areas of the two cylinders, whereby the rod is moved to the left, i.e., a load is applied so as to move the slide 2*b* downward (FIG. 6), thus enabling an adjustment which increases the load applied to a working piece (material).

Generally in the forging press of the mentioned type, slide adjustment is difficult by reason of space and, therefore, the adjustment has been preformed in most cases by providing an inclination on the lower side of a bolstar, i.e., by means of a wedge. It may be said that this well known adjustment method was largely improved by the previously mentioned prior art disclosed in Publication Nos. 32478/1984 and 75500/1990 from the viewpoint of simple operation and control. On the other hand, several disadvantages to be overcome still remain in these forging presses. That is, as shown in FIG. 5, the nut 5*a* performs a circular arc motion and together with the adjusting lever 3*a* establishes the center Q2 of the wrist pin as a fulcrum. Since the axis of the adjusting screw is linear, in order to perform such a circular arc motion, it is essential to dispose at least one universal joint 108 in the middle part of the adjusting screw to absorb a displacement between the linear motion and circular arc motion by curvature. As a result, the upper limit of the slide adjustable quantity is defined depending upon the performance of the universal joint, and the value of the upper limit is not so high at present.

Then, in the prior art shown in FIG. 6, the inclining motion of the adjusting lever is not performed by any forced drive, being different from the former prior art (FIG. 5), but the sliders 101 engagedly received in the bearing section 32*b* slide vertically and the link pin 102 held between the two sliders turns as it is held, moving horizontially along the straight rod 9*b* disposed through the link pin 102 and fixed thereto. Thus the adjusting lever 3*b* moves with the required inclination. In other words, as compared with the former prior art, the adjustable quantity of the slide is easily increased and therefore this latter prior art can meet large variations in the forging conditions, such as the shape of the mold. However, a still further problem to be overcome exists in manufacturing an apparatus of the mentioned construction. More specifically, the sliders 101 engagedly received in the bearing section 32*b* are in tight contact with the inside 32*b*-1 in the bearing section at four sides 101-1 thereof. The sliders 101 slide by receiving the movement of the rod through this surface contact. Accordingly, if the surface contact is insufficient at any of the four sides, looseness or backlash may arise inhibiting accurate slide adjustment. Thus, accuracy or precision in finish of such surfaces is a fatally important element in this prior art. However, it is not easy to finish internal surfaces of such a box-shaped member as used in this prior art precisely so as to achieve the mentioned slidable tight contact on each of the plural flat faces. Somewhat troublesome and high techniques are required for machining and assembling. Moreover, since bending stress is applied without fail to the rod 9*b* in this construction, a strength sufficient to handle such bending is required and, as a result, every component or member is obliged to be large-sized, which is a further disadvantage of these designs.

SUMMARY OF THE INVENTION

The present invention was developed to solve the above-discussed problems and has as an object the provision of an improved slide adjusting device in which difficulty in machining and assembling is ovecome while utilizing the concept shown in FIG. 7.

To accomplish the foregoing object, a slide adjusting device according to the present invention comprises a connecting rod 1 engaged from outside with an eccentric part 81 of a crankshaft 8; a slide 2 supported to be suspended by a wrist pin 6 at two ends 11 formed by branching the connecting rod into two parts; an adjusting lever 3 engaged from outside with the wrist pin 6 in such a manner as to have a center Q1 dislocated from a center Q2 of the wrist pin 6 by an amount $e_0$, the adjusting lever 3 being moved with inclination for adjustment of the slide position; a nut 5A fitted in a receiving section 32A formed protrudently in middle part of an eccentric shaft section 31 of the adjusting lever 3; discs 4 each rotatably engaged inside the receiving section 32A with a turning shaft 52A projecting from two sides of the nut 5A in the axial direction, the turning shaft 52A being eccentrically inserted in the respective discs 4; and a female screw 53A provided through the nut 5A at a right angle to the eccentric shaft section, the female screw 53A being in screw-engagement with a screw 7 supported by the sliders so as to be freely driven.

It is also preferable that a square bar member 5B is engagedly inserted in a receiving part 32B; a turning shaft 52B protruding from two sides of the square bar 5B in the axial direction is engaged with the rotatable eccentric discs 4 in two side surfaces of the receiving section 32B; and a rod 9 rotatably supported by the slide 2 is fixedly inserted so as to move freely in the horizontal direction in a through hole 53B provided through the square bar 5B at a right angle to the eccentric shaft section 31.

In the foregoing constructions, it is further preferable that the disc 4 is engagedly inserted so as to turn freely in mounting holes 34A, 34B provided through two sides 33A, 33B of the receiving section; a through hole 41 having a center Q4 eccentrically displaced from a center Q3 of the disc 4 by $e_1$ is provided through the disc 4; and the turning shaft 52A or 52B of the nut 5A or square member 5B is inserted in the through hole 41 so as to turn freely.

As mentioned above, in the slide adjusting device of the above construction, a nut 5A is fitted in the receiving section 32A formed to protrude from the middle part of the eccentric shaft section 31. On the nut 5A, the turning shaft 52A also projects from two sides thereof extending in the axial direction, other than the fitting part 51A to be fitted in the receiving section. And this turning shaft 52A is disposed through the side 33A of the nut receiving section and engaged with the disc 4 which is eccentric so as to turn freely. A female screw 53A is provided through the fitting part 51A of the nut 5A at a right angle to the turning shaft 52A. This female screw 53A is screw-engaged with the screw 7 which, in turn, is connected with a drive source (motor) and rotatably supported by the slide 2.

Accordingly, when driving the motor, rotation of the motor is transmitted to the screw 7, and the nut 5A is caused to move toward either left or right through the female screw 53A mated with the screw 7. By this operation, the eccentric shaft section 31 of the adjusting lever 3 is caused to turn clockwise or counter-clockwise using the center Q2 of the wrist pin 6 as a fulcrum through the nut receiving part. In this connection, since the axis of the screw is linear while turning of the receiving part 32 is a circular arc motion, it will be impossible for the nut to turn if the nut is fixed to inside the receiving part. Therefore the turning shaft 52A of the nut is eccentrically turned inside the side faces 33A of the receiving section by the disc 4, whereby variation in height occurring in correspondence with the turning of the receiving section is absorbed, resulting in smooth transmission of motion.

In the slide adjusting device according to the invention, every movement between one member and another required for the slide adjustment is performed in the form of a turning slide motion, and therefore every contact face therebetween is formed by either an internal surface or external surface which is circular in section. In such a turning slide, every member can be sized smaller as compared with known slides. Accordingly, in case of a slide adjusting device incorporated in a forging press to which considerable load is applied during operation, the slide adjustment according to the invention is very advantageous. By employing the mentioned circular engagement between contact faces, concentration of stress is alleviated enabling a safety factor to be established smaller in the calculation of strength, and furthermore since no bending takes place throughout the function of this slide adjusting device, almost optimum design may be achieved.

From the viewpoint of the manufacturing process of the device, since the sliding faces are formed not by combining flat faces or planes but by circular faces, it is easy to achieve and maintain a working precision, and no particular precise machine and specialized technique are required but any general purpose equipment is quite sufficient.

Other objects, features and advantages of the invention will become apparent in the course of the following description with reference to the accompanying drawings.

BRIEF DESCRIPTION OF THE DRAWINGS

In the drawings forming a part of this application,

FIGS. 4(A) and (B) are perspective views showing the essential part of another embodiment;

DESCRIPTION OF THE PREFERRED EMBODIMENTS

Figure 1B:
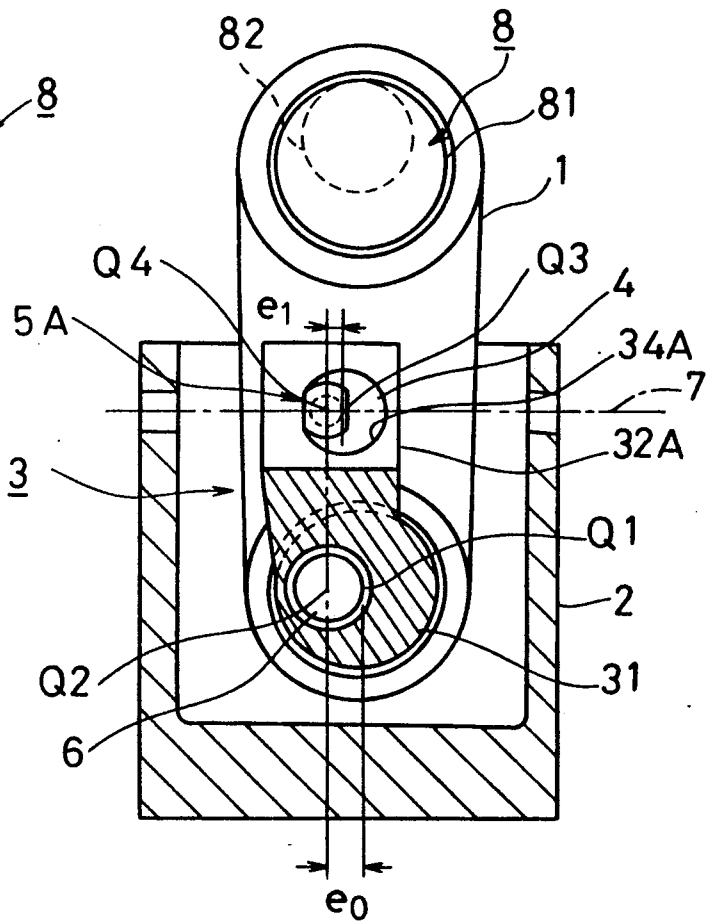
FIG. 1(B) is a sectional view taken along the line Y—Y of FIG. 1(A)
Figure 1A:
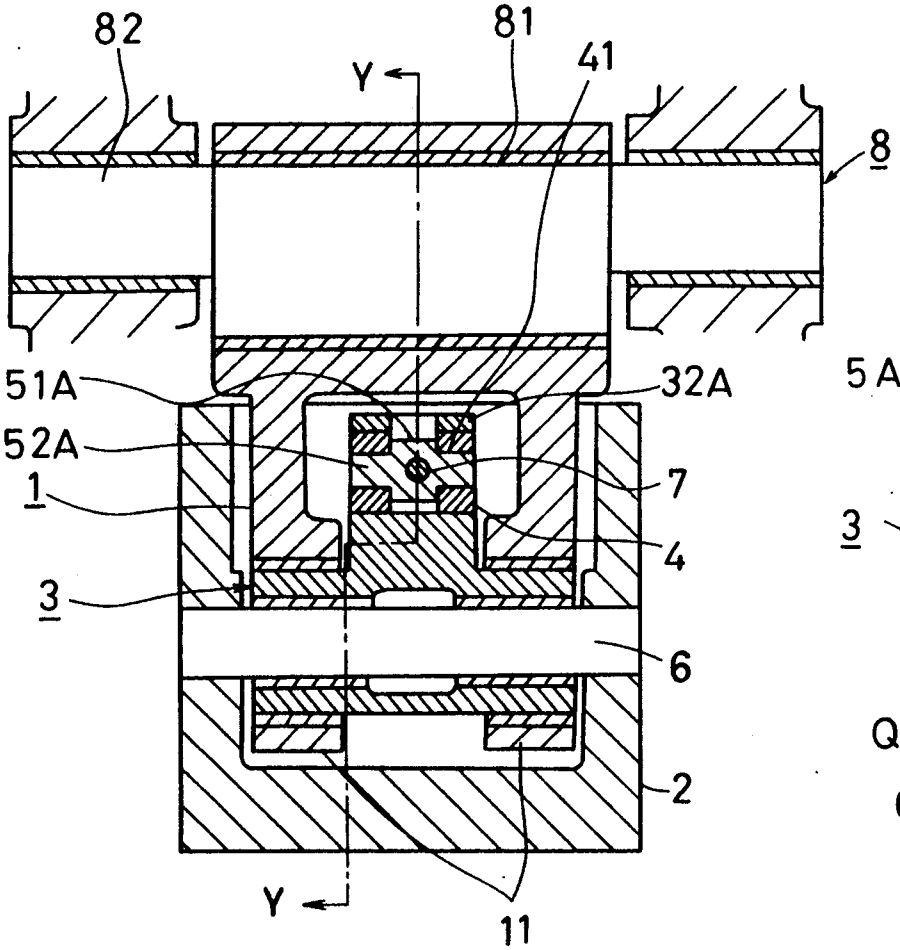
FIG. 1(A) is a longitudinal sectional front view of an embodiment according to the present invention.
Figure 2A:
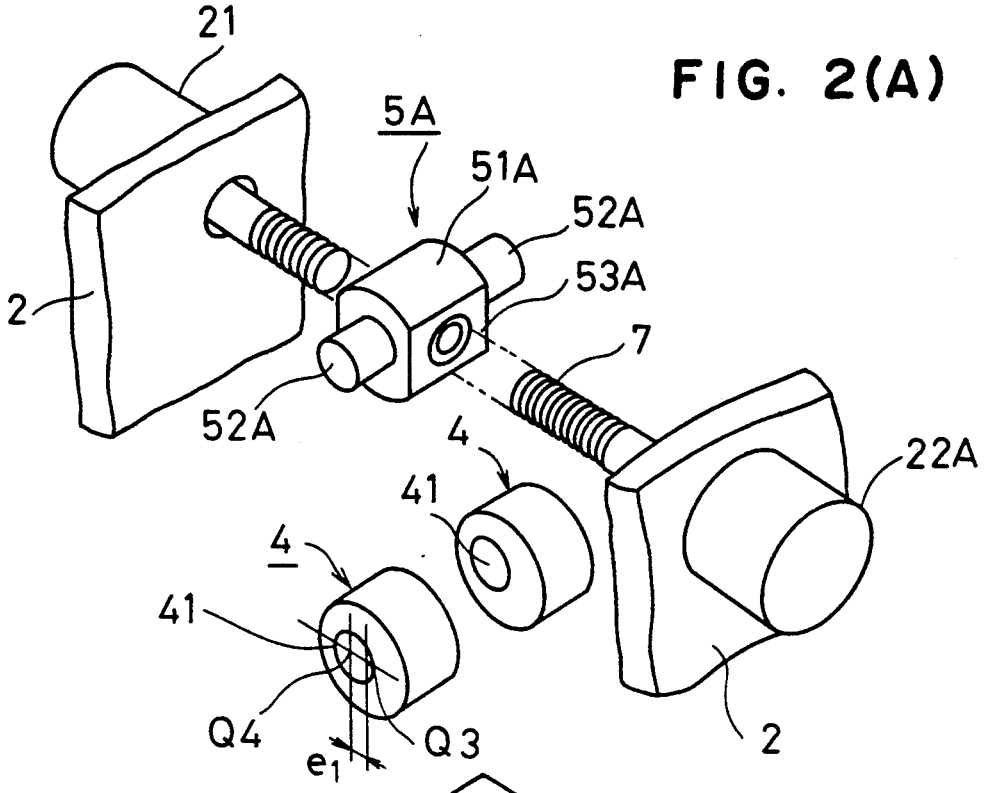
FIG. 2(A) and 2(B) are perspective views respectively showing portions of the same embodiment as shown in FIGS. 1(A) and 1(B)
Figure 2B:
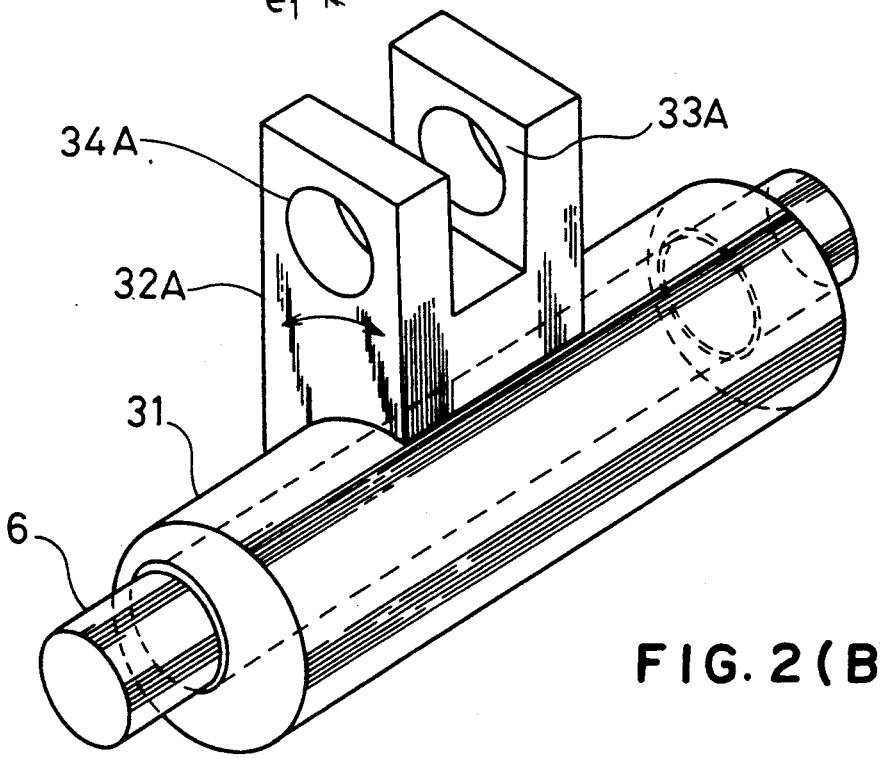

FIG. 1 shows a preferable embodiment according to the present invention. FIG. 2(A) is a perspective view of the same embodiment as shown in FIGS. 1(A) and 1(B) showing a nut 5A, a disc 4 and a screw 7. FIG. 2(B) is also a perspective view showing a connecting rod 1 and an adjusting lever 3.

Referring to these drawings, a lower part of the connecting rod 1 fitted from the outside with an eccentric part 81 of a crankshaft 8 is branched into two parts each having an end 11, and a wrist pin 6 is inserted through the eccentric part 81. Two ends of the wrist pin 6 are fitted into a slide 2 so as to support the slide 2 in suspension. Accordingly, rotation of the drive section 82 of the crankshaft is converted to vertical motion of the slide 2 through the connecting rod and wrist pin. The adjusting lever 3 having a center Q1 eccentrically displaced from the center Q2 of the wrist pin 6 by $e_0$ comprises a cylindrical eccentric shaft section 31 eccentrically engaged with the wrist pin 6, and a receiving section 32A projecting upward in the middle part of the eccentric shaft section. As shown in FIG. 2(B), two sides 33A vertically provided in parallel face each other in the receiving section, and a mounting hole 34A is provided through the center part of each side. A disc 4 is rotatably fitted in the mounting hole 34A as shown in FIG. 2(A). A through hole 41 is provided through the center part of the disc 4 so as to have the center Q4 eccentrically displaced from the center Q3 of the mounting hole by $e_1$, and the turning shaft 52A of the nut 5A is inserted through the hole 41. As shown in FIG. 2(A), a female screw 53A is provided through the fitting part 51A of the nut 5A and is put in screw-engagement with the screw 7 which is supported at two ends by a bearing 21 and a motor 22A, respectively mounted on side wall.

Figures 3A, 3B:
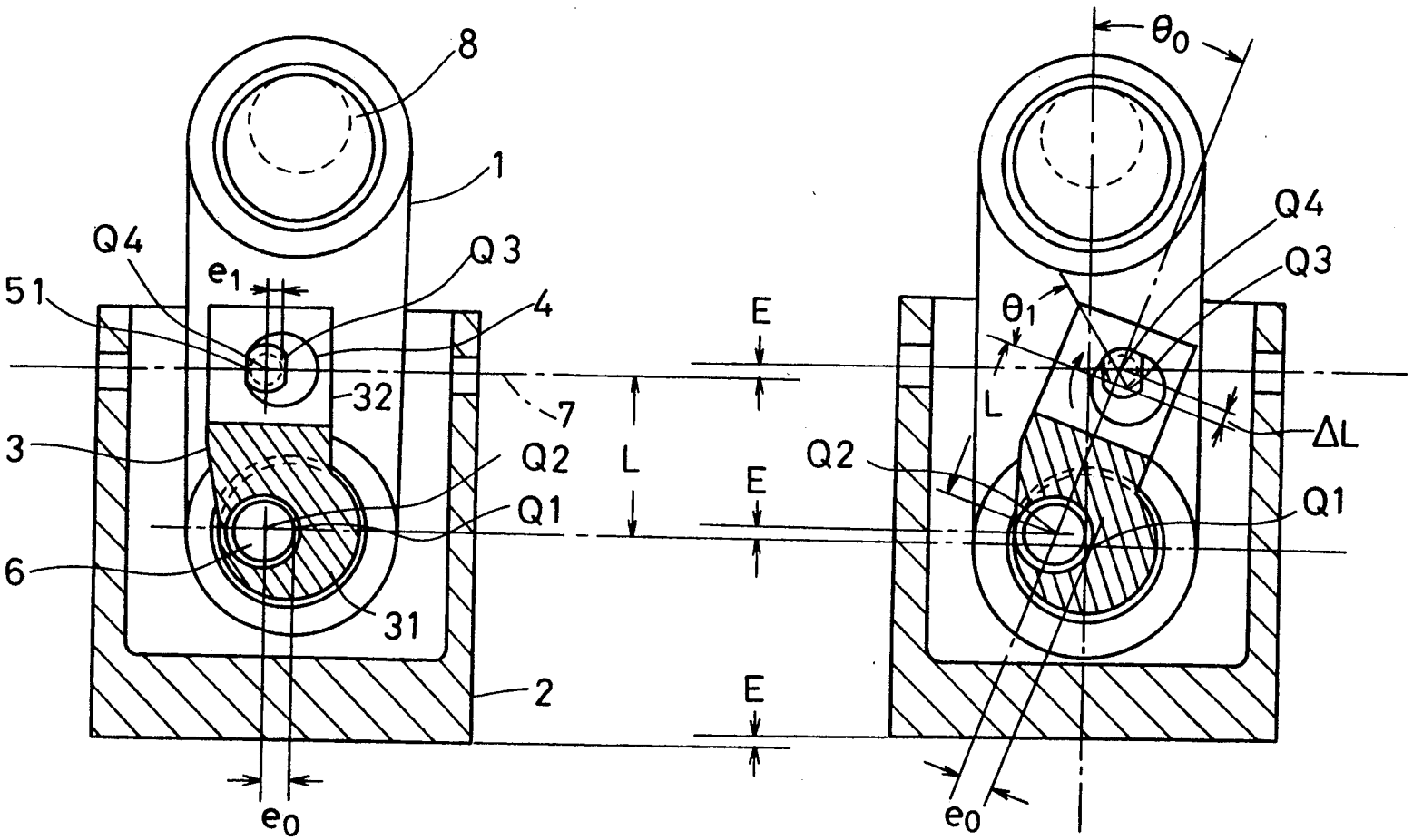
FIG. 3(A) and 3(B) are sectional views taken along the line Y—Y of FIG. 1(A) and showing the function of the invention.
Figure 5:
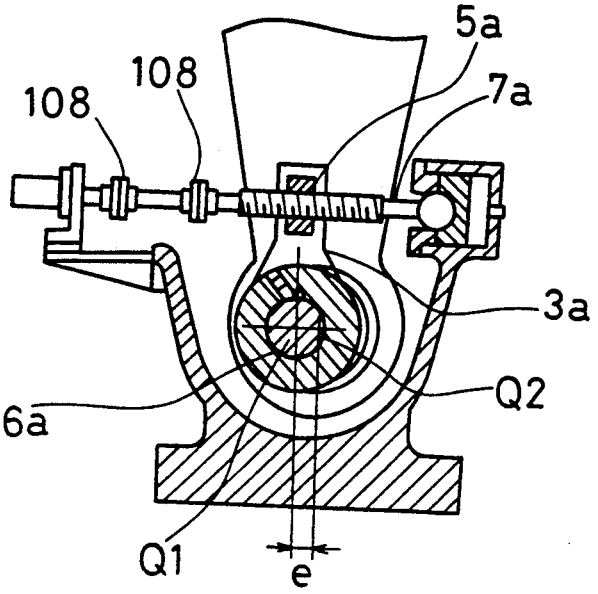
Fig.5 Prior Art.
FIG. 5 is a longitudinal sectional front view showing an embodiment of the prior art.
Figure 6:
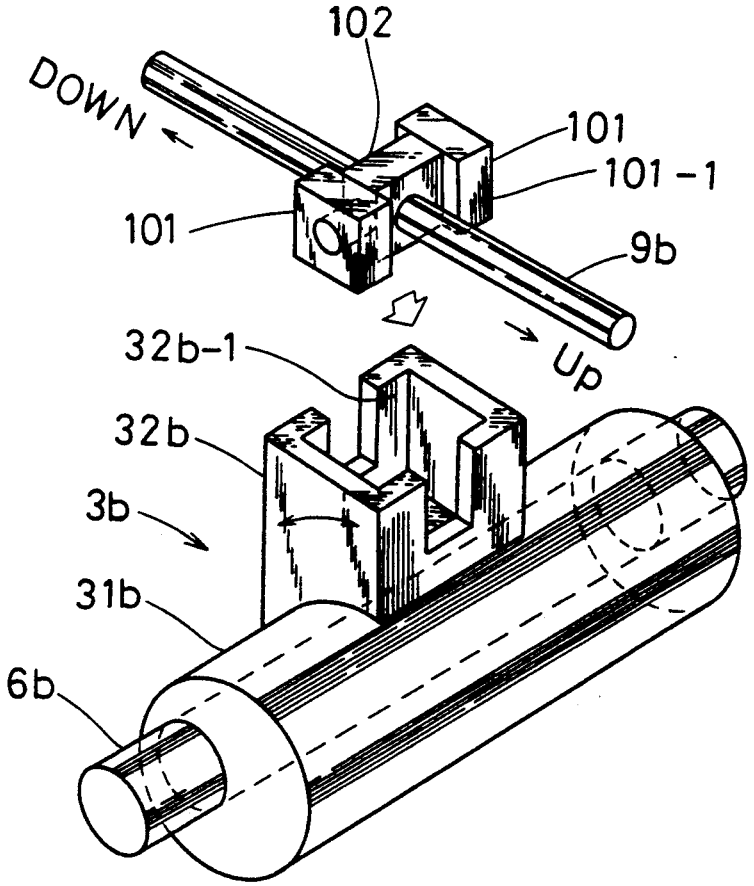
Fig.6 Prior Art.
FIG. 6 is a perspective view showing the essential part of another embodiment of the prior art.

Referring now to FIGS. 3(A) and (B) showing function of this embodiment, when the nut 5A is moved by the screw (not illustrated), the adjusting lever 3 is moved with inclination, whereby the slide 2 dislocates its position by a distance of $$E = e_0 \times \sin\theta 0$$

As a result of such an inclined movement of the adjusting lever, the distance between Q2 and Q3 is elongated and the disc 4 turns by $\theta_1$, whereby $$\Delta L = e_1 \times \sin\theta 1$$

is added to the length to meet the movement.

Figure 7B:
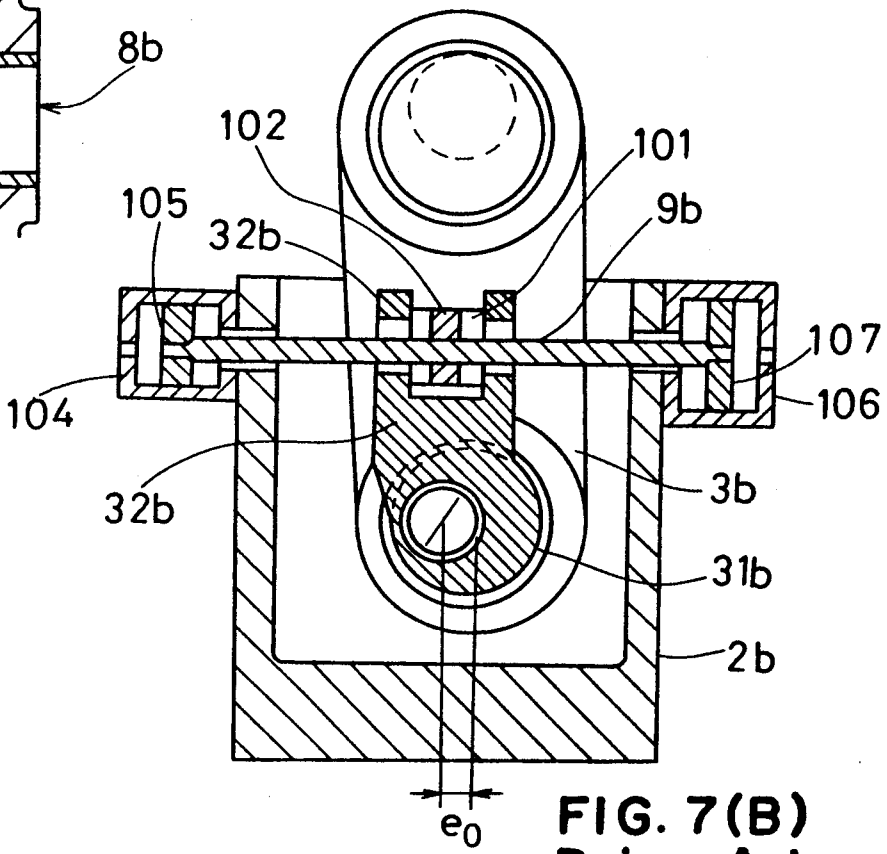
FIG. 7(B) Prior Art
FIG. 7(B) is a sectional view taken along the line Y—Y of FIG. 7(A).
Figure 7A:
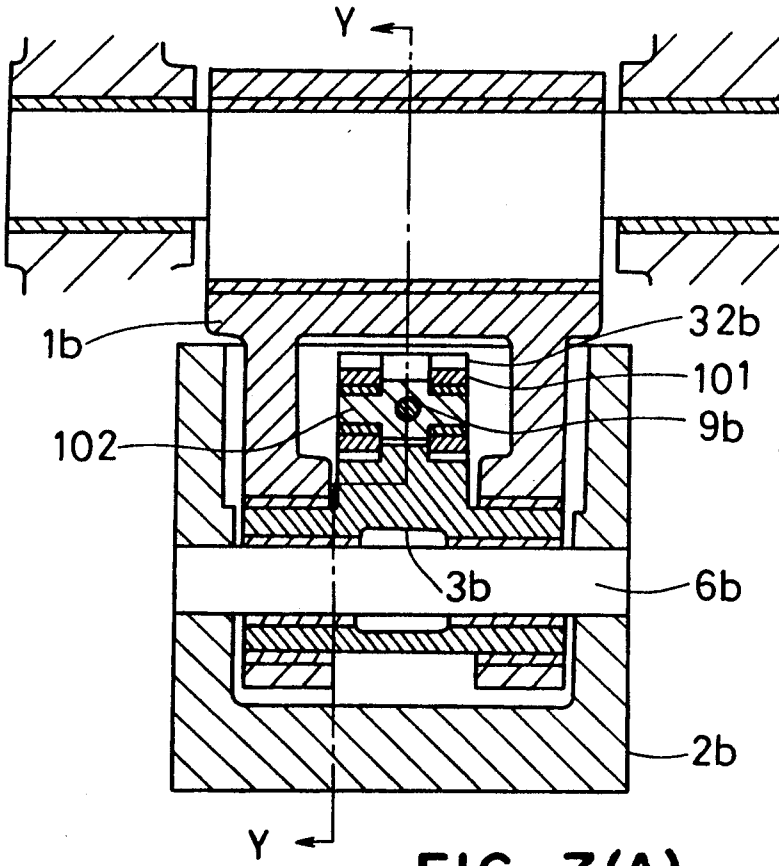
FIG. 7(A) Prior Art
FIG. 7(A) is a longitudinal sectional front view showing the same prior art.

Referring to FIG. 4 showing another embodiment, in the square member 5B engagedly inserted in the receiving section 32B, the turning shaft 52B protrudes horizontally at a right angle with respect to the axial direction and is fitted in the through hole eccentrically provided through the disc 4 likewise to that of the foregoing first embodiment. It is, however, noted that the square member 5B is not provided with any female screw threads, being different from the nut 5A tapped with the female screw 53A in the first embodiment, but the fitting part 51B is inserted through the hole 53B which is a simple circular hole without a female screw. The rod 9 is fixed to the square member 5B at the through hole and fitted into the slide 2 so as to be freely movable in the horizontal direction. Horizontal movement of the rod 9 is performed through actuation of the hydraulic mechanism 22B mounted on one of the sliders. It is also preferable that such actuation is performed by switching an electromagnetic valve for the large and small hydraulic cylinders in the same manner as the prior art mentioned with reference to FIGS. 7(A) and (B).

As many apparently widely different embodiments of this invention may be made without departing from the spirit and scope thereof, it is to be understood that the invention is not limited to the specific embodiments thereof except as defined in the appended claims.

What is claimed is:

1. A slide adjusting device, comprising:

a connecting rod having at one end means for eccentrically mounting the connecting rod to a crankshaft and at the other end a branched portion forming two parts;

a wrist pin defining a center of rotation;

a slide mounted to said connecting rod at said branched portion by said wrist pin so that it is suspended from said connecting rod;

an adjusting lever mounted by said wrist pin to said connecting rod, said adjusting lever defining a center of rotation, with the center of rotation of said adjusting lever being eccentrically located relative to the center of rotation of said wrist pin, said adjusting lever having an eccentric shaft section and a receiving section located approximately at the center of and extending outwardly from said eccentric shaft section;

a nut fitted within said receiving section, said nut including a pair of turning shafts in axial alignment and a bore extending at a right angle to the alignment of said turning shafts, said bore defining a female screw thread;

a pair of discs, each rotatably mounted in the receiving section and eccentrically on a respective one of said pair of turning shaft;

a screw defining a male screw thread on its outer surface which engages the female screw thread, said screw being rotatably mounted to said slide; and means for rotating said screw, whereby said screw when rotated effects a movement of the nut along the screw and thereby movement of said adjusting lever for adjusting said slide.

2. The slide adjusting device as defined in claim 1, wherein said receiving section defines two adjacent side parts each having a mounting hole extending therethrough, said discs being received within a respective one of said mounting holes so as to turn freely therein, wherein said discs each define a through hole the center of which is eccentrically located relative to the center of said disc, and wherein said turning shafts are each received in a respective one of said through holes so as to turn freely therein.

3. A slide adjusting device, comprising:

a connecting rod having at one end means for eccentrically mounting the connecting rod to a crankshaft and at the other end a branched portion forming two parts;

a wrist pin defining a center of rotation;

a slide mounted to said connecting rod at said branched portion by said wrist pin so that it is suspended from said connecting rod;

an adjusting lever mounted by said wrist pin to said connecting rod, said adjusting lever defining a center of rotation, with the center of rotation of said adjusting lever being eccentrically located relative to the center of rotation of said wrist pin, said adjusting lever having an eccentric shaft section and a receiving section located approximately at the center of and extending outwardly from said eccentric shaft section;

a square nut fitted within said receiving section, said nut including a pair of turning shafts in axial alignment and a bore extending at a right angle to the alignment of said turning shafts;

a rod mounted to said slide for lateral movement with respect thereto, said rod extending through said bore of said square nut and being fixedly connected therein to said square nut a pair of discs, each rotatably mounted in the receiving section and eccentrically on a respective one of said pair of turning shafts; and means for moving said rod laterally with respect to the slide, whereby lateral movement of said rod effects lateral movement of said nut and thereby movement of said adjusting lever for adjusting said slide.

4. The slide adjusting device as defined in claim 3, wherein said receiving section defines two adjacent side parts each having a mounting hole extending therethrough, said discs being received within a respective one of said mounting holes so as to turn freely therein, wherein said discs each define a through hole the center of which is eccentrically located relative to the center of said disc, and wherein said turning shafts are each received in a respective one of said through holes so as to turn freely therein.

* * * * *